US007255531B2

(12) United States Patent
Ingistov

(10) Patent No.: US 7,255,531 B2
(45) Date of Patent: Aug. 14, 2007

(54) GAS TURBINE TIP SHROUD RAILS

(75) Inventor: Steve G. Ingistov, Los Angeles, CA (US)

(73) Assignee: Watson Cogeneration Company, Carson, CA (US)

( * ) Notice: Subject to any disclaimer, the term of this patent is extended or adjusted under 35 U.S.C. 154(b) by 160 days.

(21) Appl. No.: 11/006,984

(22) Filed: Dec. 8, 2004

(65) Prior Publication Data

US 2005/0186079 A1 Aug. 25, 2005

Related U.S. Application Data

(60) Provisional application No. 60/530,117, filed on Dec. 17, 2003.

(51) Int. Cl.
*F01D 5/20* (2006.01)

(52) U.S. Cl. ..... 415/173.1; 415/173.6

(58) Field of Classification Search ..... 415/110, 415/144, 171.1, 173.1, 173.5, 173.6, 221
See application file for complete search history.

(56) References Cited

U.S. PATENT DOCUMENTS 5,201,850 A * 4/1993 Lenhardt et al. ..... 416/190
6,102,655 A 8/2000 Kreitmeier ..... 415/173.3
6,171,052 B1 * 1/2001 Aschenbruck et al. ... 415/173.1
6,962,484 B2 * 11/2005 Brandl et al. ..... 416/192
2003/0194322 A1 10/2003 Brandl et al. ..... 416/228

FOREIGN PATENT DOCUMENTS

| | | | |
|---|---|---|---|
| DE | 10179 | * | 6/1912 |
| DE | 19619722 | | 11/1977 |
| DE | 196 19 722 | * | 11/1997 |
| EP | 1413712 | | 4/2004 |
| GB | 933618 | | 8/1963 |

OTHER PUBLICATIONS

Heinrich Holzer; *Arrangement for Diminishing Clearance Losses in Turbines and Pumps for Liquids and Elastic Fluids*; No. 10, 179 A.D. 1912; Jun. 20, 1912; Love & Malcomson, Ltd.; GB.

* cited by examiner

*Primary Examiner*—Edward K. Look
*Assistant Examiner*—Devin Hanan
(74) *Attorney, Agent, or Firm*—Patrick Kim

(57) ABSTRACT

A tip shroud rail for a tip shroud of at least one turbine rotor blade, the tip shroud rail comprising a base integrally attached to the tip shroud, a top distally positioned from the base, an upstream surface, and a downstream surface, wherein the tip shroud rail has a height, h, as measured from the base to the top, and a width, w, as measured from the upstream surface to the downstream surface, wherein the width, w, of the tip shroud rail, as measured at the top, is greater than the width, w, of the tip shroud rail, as measured at one-half the height, h/2, of the tip shroud rail.

8 Claims, 5 Drawing Sheets

GAS TURBINE TIP SHROUD RAILS

This application claims the benefit of the provisional U.S. Application Ser. No. 60/530,117, filed Dec. 17, 2003.

FIELD OF INVENTION

The present invention relates to turbine blades. More particularly, the present invention relates to shrouded turbine blades having inverse trapezoidal rails.

BACKGROUND OF THE INVENTION

A gas turbine is a power plant, which produces an enormous amount of power for its size and weight. Due to their efficiency in power production, gas turbines have found increasing service in the past 40 years in the power industry, both among utilities and merchant plants, as well as in oil exploration and production, oil refining, and petrochemical industries.

In the utility industry, the past decade has seen unprecedented consumption of electricity that in many areas of the world frequently exceeds electricity supplies, leading to the possibility of power outages. In certain areas of the world, such electricity deficits have risen to crisis levels. Consequently, there is increasing pressure on utilities and independent power producers to become more efficient in producing power to increase their capacity to meet the growing demand for electricity.

In the case where gas turbine engines are used to produce power, modernizing existing fleets of gas turbines is emerging as an economically attractive solution. To that end, prior modernization efforts include, but are not limited to, improving metallurgical characteristics of gas turbine engine materials, improving combustion characteristics during operation of gas turbines, improving cooling characteristics within gas turbine engines, and improving airflow characteristics during operation of gas turbine engines.

In the area of improving airflow characteristics, parasitic loss of valuable high-temperature high-pressure combustion gases expanding through the turbine section of gas turbine engines is of paramount concern. Such parasitic loss is especially pronounced through clearance gaps located between turbine rotor blades and the outer casing of the turbine section, resulting in substantial reduction in gas turbine efficiency. Consequently, several modernization efforts have focused on reducing such parasitic loss through these clearance gaps.

For example, turbine rotor blades often have shrouds that form a band around the perimeter of a row of turbine rotor blades attached to a rotating disk (turbine wheel). These shrouded turbine rotor blades effectively reduce gas leakage around the tips of the blades and reduce blade vibration. Consequently, the use of shrouds on turbine rotor blades increases the efficiency of the gas turbine unit by improving airflow characteristics. However, in time, centrifugal forces, high temperatures and gas pressure differentials across the top and bottom of the shroud tend to "curl" and deflect the shrouds, resulting in excessive blade deformations (e.g. "creep"; i.e. elongation of the blade), increased parasitic loss, and may ultimately lead to catastrophic failure of the entire gas turbine unit.

To reduce the significance of blade deflection, it is common practice to scallop the turbine rotor blade shrouds, i.e., remove unsupported portions of the shroud. However, scalloping increases the parasitic loss of the combustion gases around the turbine rotor blades. Another common practice is to incorporate tip shroud rails in the turbine rotor blade shrouds that stiffen the shroud and form a labyrinth with matching rails of stationary shrouds attached to an outer casing of the turbine section. However, tip shroud rails currently incorporated on the turbine blade shroud have a trapezoidal profile, tapering in width as measured from the base of the rail to the top of the rail. Such a profile allows for ease of casting, but is the least effective in stiffening the shroud and in retarding parasitic loss of expanding combustion gases through the clearance gaps.

Another effort to reduce parasitic loss is the use of a honeycomb rub strip mounted to the stationary shroud, which, in turn, is supported by an outer casing. Honeycomb rub strips operate as labyrinth seals, which reduces the amount of parasitic loss of the expanding combustion gas, thereby increasing the efficiency of the gas turbine. However, the use of honeycomb rub strips requires the use of hardened cutter teeth attached to the tip shroud rails to cut a path through the honeycomb rub strip. These cutter teeth often damage the honeycomb rub strip and significant portions of the tip shroud rail grind down during operation of the gas turbine, resulting in partial or complete loss of the rails. Consequently, parasitic loss of expanding combustion gases between clearance gaps dramatically increases and the turbine rotor blades suffer accelerated deflection, resulting in substantial power loss and ultimately catastrophic failure of the gas turbine unit.

Although these efforts are advances in the art, there is still a need to increase gas turbine efficiency without compromising the long term mechanical reliability of the gas turbine. It has been found that generating a vortex or air dam at the leading edge of the tip shroud rails advantageously reduces parasitic air loss by restricting the flow of the combustion gases through the clearance gaps and redirecting the flow of the combustion gases to the airfoils of the turbine rotor blades, eliminating the need to use honeycomb rub strips to reduce parasitic air loss.

It has also been found that employing tip shroud rails that taper in width as measured from the top of the tip shroud rail to the base of the tip shroud rail dramatically reduces parasitic loss of expanding combustion gases between clearance gaps over existing tip shroud rails that taper in width as measured from the base of the tip shroud rail to the top of the tip shroud rail.

It has also been found that employing tip shroud rails that have a concave upstream surface dramatically reduces parasitic loss of expanding combustion gases between clearance gaps over conventional tip shroud rails.

It has also been found that employing tip shroud rails that have a convex upstream surface dramatically reduces parasitic loss of expanding combustion gases between clearance gaps over conventional tip shroud rails.

SUMMARY OF THE INVENTION

Therefore, the present invention is directed to a tip shroud rail that comprises a base that is integrally attached to a tip shroud of at least one turbine rotor blade, a top distally from the base, an upstream surface, and a downstream surface. The rail has a height, h, as measured from the base to the top, and a width, w, as measured from the upstream surface to the downstream surface, and in one embodiment the width, w, of the rail, as measured at the top, is greater than the width, w, of the rail, as measured at one-half the height, h/2, of the rail. Such dimensions may include, but are not limited to, tip shroud rails with upstream and/or downstream surfaces that are concave in profile.

In another embodiment, the width, w, of the rail, as measured at the top of the rail, is greater than the width, w, at the base of the rail. Such dimensions may include, but are not limited to, tip shroud rails that taper in width from the top of the rail to the base of the rail.

In yet another embodiment, the width, w, of the rail at the top of the rail is greater than the width of the rail at half the height, h/2, of the rail. Such dimensions may include, but are not limited to, tip shroud rails with upstream and/or downstream surfaces that are convex in profile.

The present invention provides for substantial cost-savings during the operation of a gas turbine unit, such as reducing unnecessary parasitic loss of expanding combustion gases through the clearance gaps between the turbine rotor blades and the stationary shrouds.

The present invention provides for substantial savings in capital and maintenance expenditures by extending the life of turbine rotor blades and reducing the need for regular scheduled maintenance of gas turbine units.

The present invention provides for substantial safety benefits to person and property by avoiding dangerous operating conditions that can result in catastrophic failure of the gas turbine unit.

The present invention also provides for a simple design option to prevent parasitic loss of valuable high-temperature high-pressure combustion gases, facilitating retrofitting of existing gas turbines utilized throughout industry.

DESCRIPTION OF THE PREFERRED EMBODIMENT(S)

Figure 1:
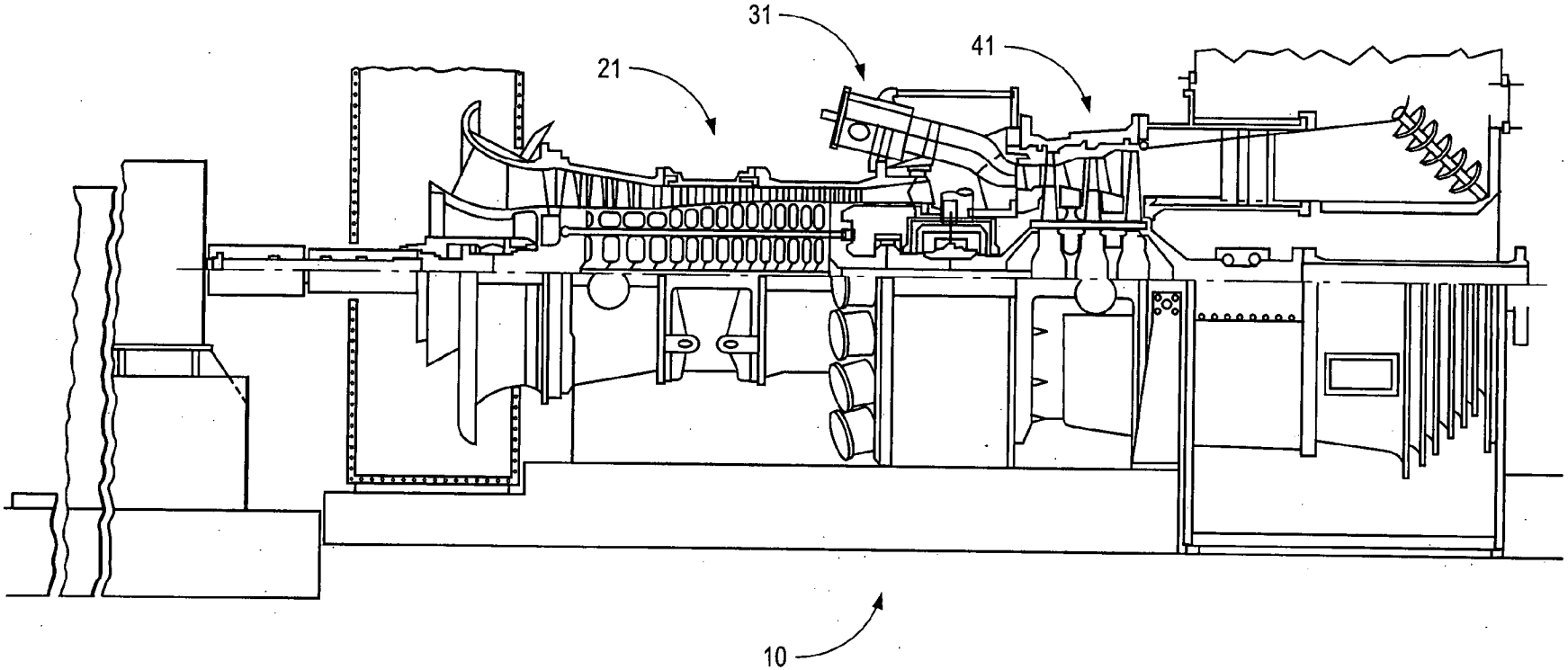
FIG. 1 PRIOR ART
FIG. 1 is a longitudinal sectional view of a frame-type gas turbine with can-annular combustors.

In greater detail, gas turbines frequently employed in the utility and petrochemical industries, include but are limited to, frame type heavy-duty gas turbines, aircraft-derivative gas turbines, industrial-type gas turbines, small gas turbines and micro-turbines. Conventional frame-type gas turbines are large power generation units, and are particularly suitable in the utility industry. As shown in FIG. 1, these frame-type gas turbines 10 typically comprise an axial-flow compressor 21, a combustor 31, and an axial flow turbine 41.

Figure 2:
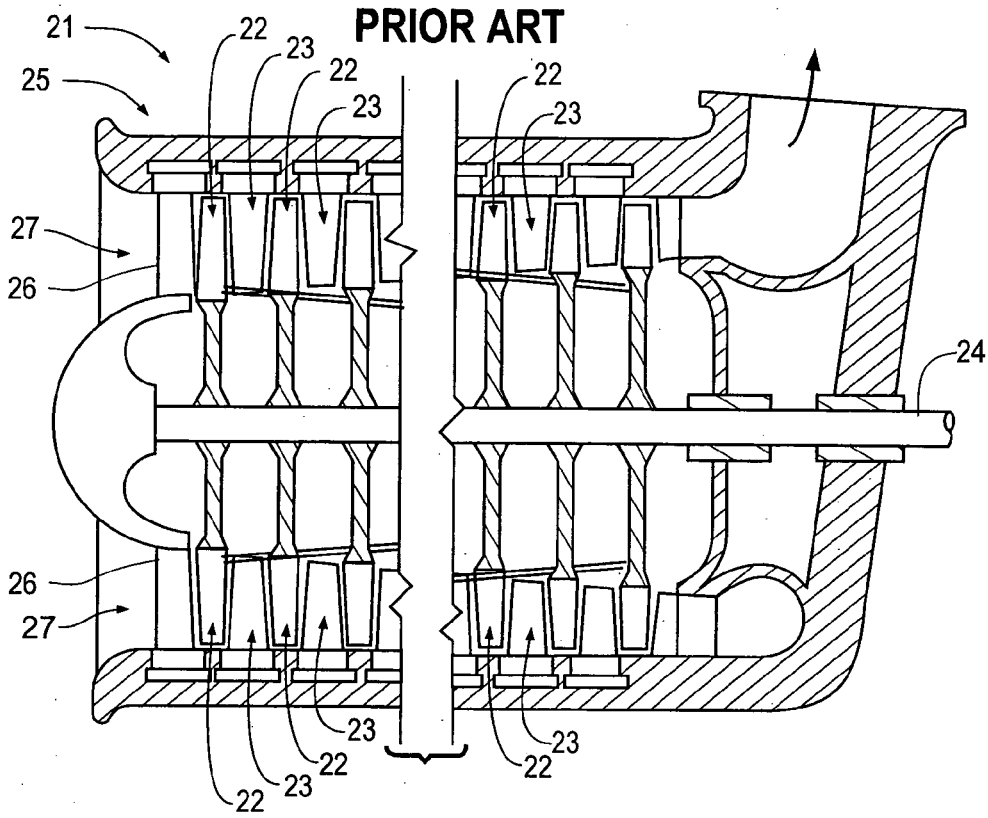
FIG. 2 PRIOR ART
FIG. 2 is a sectional view of a multi-stage axial compressor.

Axial flow compressors 21, as shown in FIG. 2, typically comprise multiple compressor stages, each compressor stage comprising a row of rotating blades (rotor) 22 and a row of stationary blades (stator) 23. The rotors 22 are concentrically mounted to a rotor disk or shaft 24 that rotates about a centerline axis of the gas turbine, forming an annular blade arrangement within a compressor outer casing 25. The stators 23 are mounted to the outer compressor casing 25 between each rotor 22. In addition to these compressor stages, axial-flow compressors 21 often employ an additional row of fixed blades (inlet guide vanes) 26 at a compressor air inlet 27 to ensure that air enters the first stage rotors at a desired angle.

Figure 3:
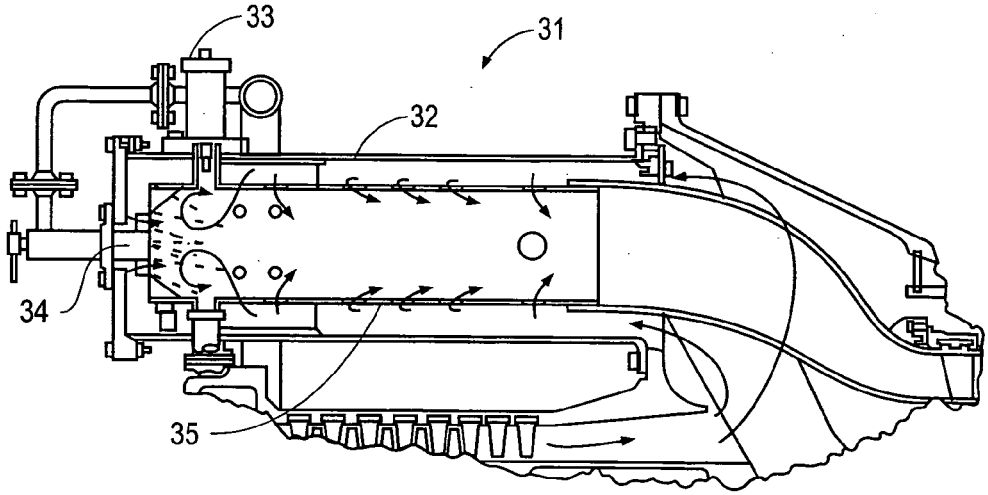
FIG. 3 PRIOR ART
FIG. 3 is a sectional view of a can-annular combustor.

The combustor 31, as shown in FIG. 3, typically comprises a combustion chamber 32, at least one igniter plug 33 and at least one fuel nozzle 34 or fuel injector. The combustion chamber 32 typically comprises the fuel nozzles 34 or fuel injectors, the igniter plugs 33, and a perforated inner lining 35. The fuel injectors or nozzles 34 deliver fuel into the incoming compressed air within the combustion chamber 32. The fuel may include, but is not limited to natural gas, diesel fuel, naphtha, crude, low-Btu gases, vaporized fuel oils and biomass gases. The igniter plugs 33 initially ignite the fuel-fuel air mixture, producing a high-temperature, high-pressure combustion gas. The perforated inner lining 35 diffuses the incoming compressed air to allow for a continuous flame within the combustion section.

Figure 4:
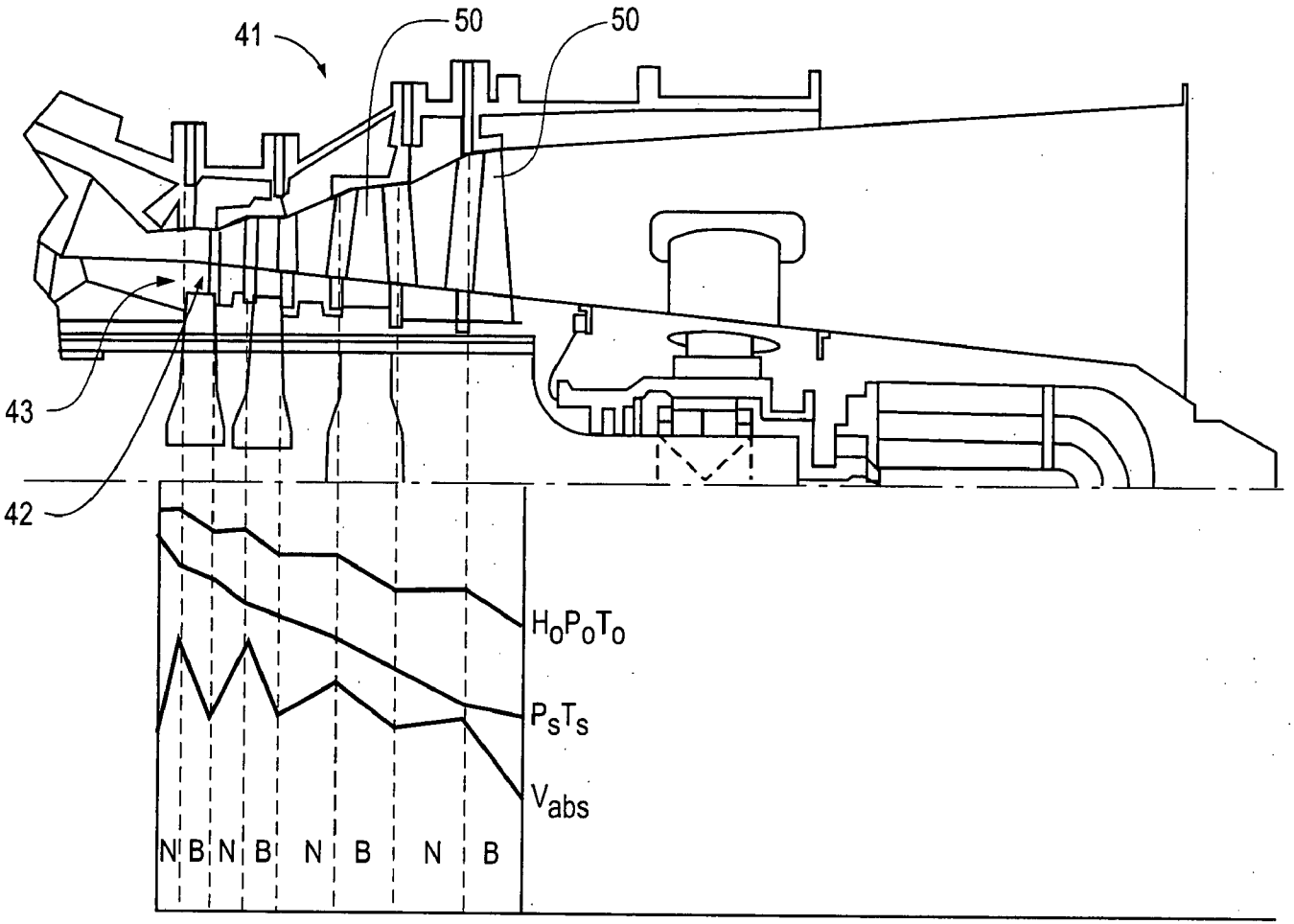
FIG. 4 PRIOR ART
FIG. 4 is a sectional view of an axial flow turbine.

Axial flow turbines 41, as shown in FIG. 4, comprise two main elements: turbine wheels 42 (rotating portion) and stationary vanes 43 (stationary portion). The turbine wheels comprise turbine rotor blades 50, attached to a rotating disc 44, usually by means of a fir tree design to handle different rates of expansion of the incoming combustion gases while still holding the turbine rotor blades against centrifugal loads. The axial flow turbine 41 may either have a single stage or multiple stages. When the turbine 41 has multiple stages, stationary vanes 43 are inserted between each turbine wheel 42. Stationary vanes 43 are oftentimes placed at the entrance and exit of the turbine 41. The stationary vanes 43 are contoured and concentric with the axis of the turbine section and set at an angle to form a series of small nozzles. These nozzles discharge high-temperature, high-pressure combustion gases onto the turbine rotor blades 50.

Figure 5:
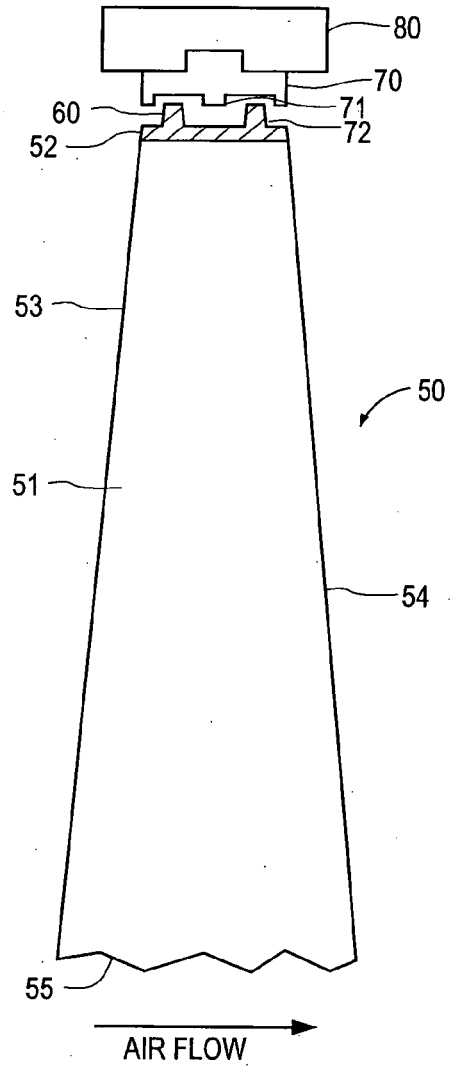
FIG. 5 PRIOR ART
FIG. 5 is a side view of a typical turbine rotor blade having a tip shroud.

A typical turbine rotor blade 50, as shown in FIG. 5, has an airfoil section 51 and a tip shroud 52 attached to an outer end of the airfoil section 51. Attached to an outer surface of the tip shroud 52 is at least one tip shroud rail 60. The airfoil section 51 comprises an upstream leading edge 53 and a downstream trailing edge 55. The airfoil section 51 extends longitudinally along a longitudinal or radial axis in a spanwise direction of the airfoil section 51 from an airfoil base 56 to the tip shroud 52.

Figure 6:
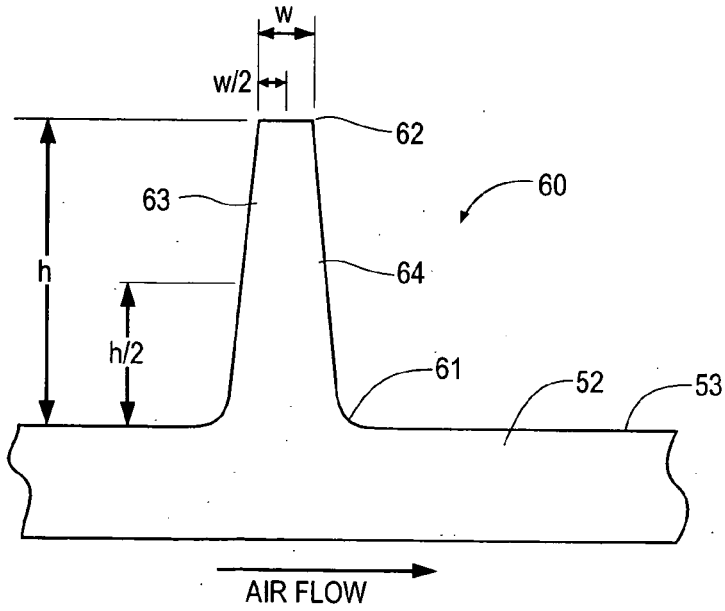
FIG. 6 PRIOR ART
FIG. 6 is a side view of a typical tip shroud having a tip shroud rail.

Typical tip shroud rails 60, as shown in FIG. 6, comprise a base 61 attached to the outer surface 53 of a tip shroud 52 and extending distally to a top 62 of the tip shroud rail 60. The tip shroud rails 60 also have a upstream surface 63 and a downstream surface 64. The tip shroud 60 has a height, h, extending from its base 61 to its top 62, and a width, w, extending from its leading surface 63 to its trailing edge 64. Tip shroud rails 60 are typically trapezoidal in shape, tapering in width, w, as measured from its base 61 to its top 62.

Referring again to FIG. 5, surrounding a respective row of turbine rotor blades 50 are one or more stationary shrouds 70 attached to an outer casing 80 of the turbine section. Each stationary shroud 70 is preferably formed in a plurality of circumferential adjoining arcuate segments that collectively form a complete ring around the tip shrouds 52 of each row of turbine rotor blades 50. Integrally attached to one or more stationary shroud 70 are typically one or more stationary shroud rails 71. The space between the tip shrouds 52 and the stationary shrouds is the clearance gap 72. At least one stationary shroud rail 70 is preferably aligned to match at least one tip shroud rail 60 to form a labyrinth in the clearance gap 72. Oftentimes, each stationary shroud 70 includes a honeycomb rub strip (not shown) fixedly joined or bonded directly to an inner surface of the stationary shroud 70 to reduce the parasitic loss of combustion gases through the clearance gaps 72. In the event a honeycomb rub strip is employed, hardened cutter teeth (not shown) may be attached to the tip shroud rails in a manner to cut a path through the honeycomb rub strip.

During operation of the gas turbine engine, the compressor 21 intakes air through the air inlet 27 and compresses the air by first accelerating the air with the rotors 22 and then diffusing the air with the stators 23 to obtain a pressure increase. The compressed air is directed into the combustor 31 where it is intermixed with fuel. The fuel is ignited, producing a high-temperature high-pressure combustion gas, which flows axially to the axial flow turbine 41 and expands through a series of turbine rotor blades 50. The turbine rotor blades 50 extract energy from the high temperature high-pressure gas, creating rotational energy that drives the compressor 21 and other mechanical components, including, but not limited to, a fan, propeller and output shafts. Consequently, the efficiency at which the turbine rotor blades can extract energy from the expanding combustion gases has direct relationship on the overall performance of the gas turbine.

The subject invention increases the overall efficiency at which the turbine rotor blades can extract energy from the expanding combustion gases by advantageously employing one or more tip shroud rails that are capable of generating a vortex at the leading surface of the tip shroud rails. The vortex acts as an air dam, restricting the flow of at least a portion of combustion gases through the clearance gaps and redirecting the flow of at least a portion of the combustion gases to the airfoils of at least one turbine rotor blade.

Figure 7:
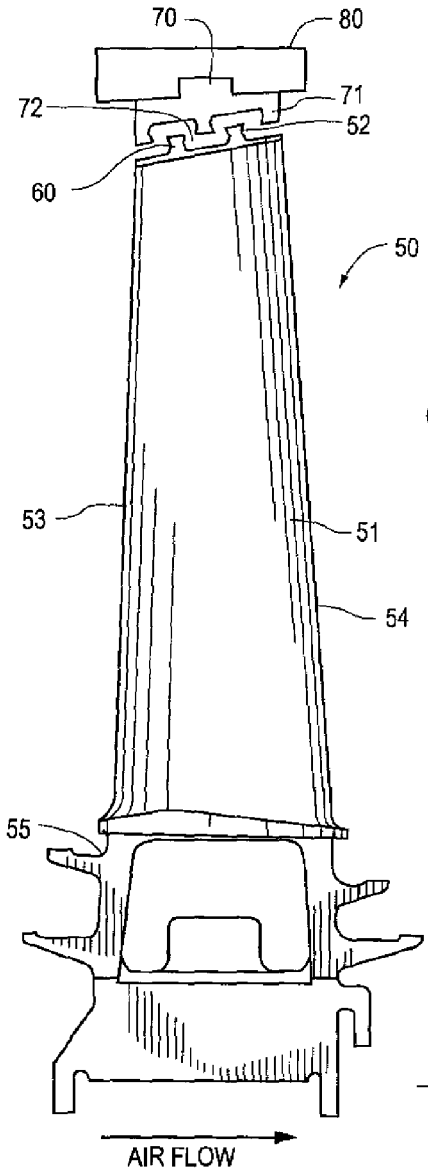
FIG. 7 is a side view of a turbine rotor blade having a tip shroud according to the subject invention.

Referring now to FIG. 7, the shrouded turbine rotor blade 50 according to the subject invention has an airfoil section 51 and a tip shroud 52 attached an outer end of the airfoil section 51. The airfoil section 51 comprises an upstream leading edge 53 and a downstream trailing edge 54. The airfoil section 51 extends longitudinally along a longitudinal or radial axis in a spanwise direction of the airfoil section 51 from a inner airfoil base 55 to the tip shroud 52. Integrally attached to an outer surface of at least one tip shroud 52 is at least one tip shroud rail 60. One or more tip shroud rails 60 according to the subject invention are of a shape (profile) that is capable of generating a vortex at the leading surface of the tip shroud rails.

Figure 8:
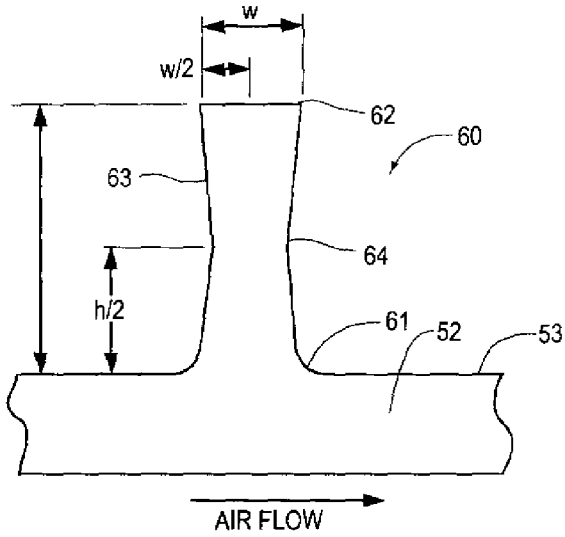
FIG. 8 is a side view of a tip shroud having a tip shroud rail according to the subject invention.
Figure 9:
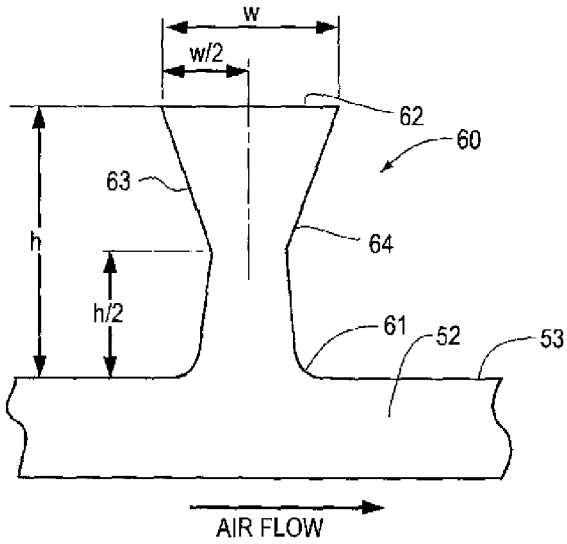
FIG. 9 is a side view of a tip shroud having a tip shroud rail with the width at the top being greater than the width at the base.

As shown in FIG. 8, the tip shroud rail 60 according to the subject invention has a base 61 integrally attached to the tip shroud 52 and extending distally to a top 62 of the tip shroud rail 60. The tip shroud rail 60 also has an upstream surface 63 and a downstream surface 64. The tip shroud rail 60 has a height, h, extending from its base 61 to its top 62, and a width, w, extending from its upstream surface 63 to its downstream surface 64. In a preferred embodiment, the width of at least one tip shroud rail, as measured at the top 62 of the tip shroud rail 60, is greater than the width of the tip shroud rail 60, as measured at the base of the tip shroud rail 60. In another preferred embodiment, the width, w, of the tip shroud rail 60, as measured at the top 62 of the tip shroud rail 60, is greater than the width of the tip shroud rail 60, as measured at half the height, h/2, of the tip shroud rail 60. Such dimensions are effective in generating a vortex at the upstream surface 63 of the tip shroud rail 60, and may be of a profile that includes, but is not limited to, an inverse trapezoidal profile. That is, at least one tip shroud rail 60 tapers in width, w, as measured from its top 62 to its base 61.

In a highly preferred embodiment, the width of the tip shroud rail, as measured at the top 62 of the tip shroud rail 60 and the base 61 of the tip shroud rail 60, is greater than the width of the tip shroud rail 60, as measured at half the height, h/2, of the tip shroud rail 60. In a highly preferred embodiment that fit these dimensions, the upstream surface 63 of the tip shroud rail 60 has a substantially concave profile as measured from the top 62 of the shroud rail 60 to the base 61 of the shroud rail 60. In another embodiment that fits this dimension, the downstream surface 64 of the tip shroud rail 60 has a substantially concave profile as measured from the top 62 of the shroud rail 60 to the base 61 of the shroud rail 60.

In yet another preferred embodiment, the width, w, of the tip shroud rail 60, as measured at one-half the height, h/2, of the tip shroud rail 60, is greater than the width, w, of the tip shroud rail 60, as measured at the base 61. In a highly preferred embodiment that fits these dimensions, the upstream surface 63 of the tip shroud rail 60 has a substantially convex profile as measured from the top 62 of the shroud rail 60 to the base 61 of the shroud rail 60. In another embodiment that fits this dimension, the downstream surface 64 of the tip shroud rail 60 has a substantially convex profile as measured from the top 62 of the shroud rail 60 to the base 61 of the shroud rail 60.

Although the foregoing preferred embodiments are directed towards tip shroud rails, the profiles, shapes and dimensions of the preferred embodiments described herein may also apply to stationary shroud rails.

The present invention provides for substantial cost-savings during the operation of a gas turbine unit, such as reducing unnecessary parasitic loss of expanding combustion gases through the clearance between the turbine rotor blades and the stationary shrouds. The end result is a gas turbine unit with improved airflow characteristics, thereby producing more power without additional fuel consumption.

The present invention provides for substantial savings in capital and maintenance expenditures by preventing tip rail damage and turbine rotor blade deflection, thereby extending the life of turbine rotor blades and reducing the need for regular scheduled maintenance of gas turbine units.

The present invention provides for substantial safety benefits to person and property by preventing tip rail damage and turbine rotor blade deflection that can result in catastrophic failure of the gas turbine unit.

The present invention also provides for a simple design option to prevent parasitic loss of valuable high-temperature, high-pressure gases, facilitating retrofitting of existing gas turbines utilized throughout industry.

Although embodiments of this invention have been shown and described, it is to be understood that various modifications and substitutions, as well as rearrangement of parts and equipment, can be made by those skilled in the art without departing from the novel spirit and the scope of this invention.

That which is claimed is:

1. A tip shroud rail for a tip shroud of at least one turbine rotor blade, the tip shroud rail comprising:

a base attached to the tip shroud;

a top distally positioned from the base;

an upstream surface having a concave profile; and a downstream surface having a concave profile;

wherein the tip shroud rail has a height, h, as measured from the base to the top, and a width, w, as measured from the upstream surface to the downstream surface;

wherein the width, w, of the tip shroud rail, as measured at the top, is greater than the width, w, of the tip shroud rail, as measured at one-half the height, h/2, of the tip shroud rail.

2. A tip shroud rail for a tip shroud of at least one turbine rotor blade, the tip shroud rail comprising:

a base attached to the tip shroud;

a top distally positioned from the base;

an upstream surface; and a downstream surface having a concave profile;

wherein the tip shroud rail has a height, h, as measured from the base to the top and a width w, as measured from the u stream surface to the downstream surface;

wherein the width, w, of the tip shroud rail, as measured at the top, is greater than the width, w, of the tip shroud rail, as measured at one-half the height, h/2, of the tip shroud rail.

3. A tip shroud rail for a tip shroud of at least one turbine rotor blade, the tip shroud rail comprising:

a base attached to the tip shroud;

a top distally positioned from the base;

an upstream surface; and a downstream surface having a concave profile;

wherein the tip shroud rail has a height, h, as measured from the base to the to and a width w as measured from the u stream surface to the downstream surface;

wherein the width, w, of the tip shroud rail, as measured at the top, is greater than the width, w, of the tip shroud rail, as measured at one-half the height, h/2, of the tip shroud rail;

wherein the width, w, of the tip shroud rail, as measured at the base, is greater than the width of the tip shroud rail, as measured at one-half of the height, h/2, of the tip shroud rail.

4. A tip shroud rail for a tip shroud of at least one turbine rotor blade, the tip shroud rail comprising:

a base integrally attached to the tip shroud;

a top distally positioned from the base;

an upstream surface; and a downstream surface having a concave profile;

wherein the tip shroud rail has a height, h, as measured from the base to the top, and a width, w, as measured from the upstream surface to the downstream surface;

wherein the width, w, of the tip shroud rail, as measured at the top, is greater than the width, w, of the tip shroud rail, as measured at the base.

5. The tip shroud rail of claim 4, wherein the width, w, of the tip shroud rail, as measured at the top, is greater than the width, w, of the tip shroud rail, as measured at one-half the height, h/2, of the tip shroud rail.

6. A tip shrouded turbine rotor blade comprising:

an airfoil comprising an outer section;

a tip shroud integrally attached at the outer section of the airfoil;

at least one tip shroud rail comprising a base integrally attached to the tip shroud; a top extending radially from the base; an upstream surface and a downstream surface, wherein the downstream surface has a concave profile; and further wherein the tip shroud rail has a height, h, extending from the base to the top, and a width, w, extending from the upstream surface to the downstream surface;

wherein the width, w, of the tip shroud rail, as measured at the top, is greater than the width, w, of the tip shroud rail, as measured at one-half the height, h/2, of the tip shroud rail.

7. The tip shrouded turbine rotor blade of claim 6, wherein the leading upstream surface of the tip shroud rail has a concave profile.

8. A stationary shroud rail for a stationary shroud, the stationary shroud rail comprising:

a base integrally attached to the stationary shroud;

a top distally positioned from the base;

an upstream surface;

a downstream surface having a concave profile;

wherein the stationary shroud rail has a height, h, extending from the base to the top, and a width, w, extending from the upstream surface to the downstream surface;

wherein the width, w, at the top of the stationary shroud rail is greater than the width, w, at the base of the stationary shroud rail.

* * * * *